US005355803A

United States Patent [19]

Robinet et al.

[11] Patent Number: 5,355,803

[45] Date of Patent: Oct. 18, 1994

[54] IGNITER PLUG

[75] Inventors: Jean Robinet, Balma; Daniel Casenave, Castanet Tolosan, both of France

[73] Assignee: Ruggieri, Neuilly sur Seine, France

[21] Appl. No.: 8,987

[22] Filed: Jan. 26, 1993

[30] Foreign Application Priority Data

Jan. 29, 1992 [FR] France ..... 92 00931

[51] Int. Cl.[5] ..... F42B 27/00

[52] U.S. Cl. ..... 102/487; 102/254; 102/486

[58] Field of Search ..... 102/254, 482, 486, 487, 102/488

[56] References Cited

U.S. PATENT DOCUMENTS

| | | | |
|---|---|---|---|
| 2,872,866 | 2/1959 | Brown et al. | 102/487 |
| 3,505,959 | 4/1970 | Lohnert et al. | 102/487 |
| 3,683,814 | 8/1972 | Bedall et al. | 102/487 |

FOREIGN PATENT DOCUMENTS

| | | | |
|---|---|---|---|
| 2389094 | 12/1978 | France | 102/487 |
| 2447006 | 2/1980 | France | 102/487 |

*Primary Examiner*—Harold J. Tudor
*Attorney, Agent, or Firm*—Sughrue, Mion, Zinn, Macpeak & Seas

[57] ABSTRACT

Delay igniter plug for pyrotechnic machine, in particular manual or mechanical launch grenade, comprising a body (4) fitted with a control mechanism comprising a trigger lever (1) and a percussion mechanism (28) interacting with a primary pyrotechnic module provided with a primer (3), a retardant composition (9), a primary explosive (13) which are capable of ensuring initiation of the charge of the associated machine which is arranged so that the primary explosive (13) cannot be initiated without going via the retardant composition, the primary pyrotechnic module (5) being axially displaceable in the said body toward the principal charge, means (2) for holding the primary pyrotechnic module (5) axially separated from the principal charge (19) and a screen (12*a*, 15) interposed between the principal charge and the terminal part of the primary pyrotechnic module containing the primary explosive (13), characterized in that the means (2) for holding the primary pyrotechnic module (5) axially separated from the principal charge (19) are exclusively mechanical means, actuated by the trigger lever (1) and in that the screen interposed between the principal charge and the terminal part of the primary pyrotechnic module (5), comprises a closure cap (15) of a cup (18) containing the principal charge (19) and a pellet (12*a*) carried by the end of the primary pyrotechnic module (5) containing the primary explosive (13) and engaged in the cap (15), the pellet (12*a*) and the cap (15) being shaped in order to be made integral with each other in the case of excitation of the primary explosive (13) in the storage position and to create a physical barrier to the shock wave or to the fragments.

10 Claims, 5 Drawing Sheets

IGNITER PLUG

BACKGROUND OF THE INVENTION

The subject of the present invention is an improvement to delay igniter plugs for pyrotechnic machines, these machines being in particular grenades usable by hand or with mechanical launch means, and having explosive, smoke-generating, light-production or combined functions.

French Patent no. 76 00 800 describes an igniter plug provided with a trigger lever fitted with a locking pin and associated with a percussion mechanism for a sealed pyrotechnic module. The latter comprises an initiator, a delay composition, a primary explosive and a principal initiation charge capable of ensuring the initiation of the charge of the associated machine, this module being made integral in a leaktight manner with the body of the plug.

This plug has the advantage of guaranteeing sufficient leaktightness between the igniter system and the other constituent elements of the pyrotechnic chain of the module, so that the primary explosive cannot be initiated other than through the delay composition.

The first addition no. 76 17 248 to the aforementioned patent describes means for guiding the trigger lever in rotation over a given angular sector, after unlocking of this lever, so as to allow quasi-instantaneous release of the lever in question as soon as it has exceeded the guidance angular sector. According to a preferred embodiment, the body of the plug is also provided with two lateral slopes arranged beneath the trigger lever, so as to guide the latter in rotation after unlocking, and by interaction of the slopes with two corresponding lateral cheeks of the lever.

In these two known embodiments, the pyrotechnic module, which is mounted stationary with respect to the body of the plug, constitutes a complete pyrotechnic chain, capable of functioning in the case of accidental excitation of the primer, besides normal mechanical triggering by the lever and its associated percussion mechanism, this normal triggering comprising, in order, removal of the pin, release of the lever and percussion of the primer.

It has thus been observed that hand grenades can explode accidentally in the case of falling onto very hard ground, prolonged storage in premises with an abnormally high temperature, exposure to electromagnetic fields leading either to induced currents or to the formation of electrostatic charges which can influence, either by direct action, or by discharge, premature functioning of the primer.

In the aim of improving the safety of the storage and of the use of these pyrotechnic machines, in particular by removing any risk of accidental triggering of the principal primer charge and consequently of the charge of the corresponding machine, French Patent no. 78 17 119 described an igniter plug in which the pyrotechnic module is separated from the principal primer charge, and the igniter plug is fitted with a safety device capable of preventing triggering of the principal primer charge in the case in which the excitation of the primer has an origin other than the normal percussion mechanism of the plug.

SUMMARY OF THE INVENTION

The present invention more precisely relates to igniter plugs of the latter type. It aims to provide novel means for constituting the interruption screen between the pyrotechnic module and the final charge in order further to reinforce the safety of storage and of use of the igniter plug.

Its subject is therefore a delay igniter plug for pyrotechnic machine, in particular manual or mechanical launch grenade, comprising a body fitted with a control mechanism comprising a trigger lever and a percussion mechanism interacting with a primary pyrotechnic module provided with a primer, a retardant composition, a primary explosive which are capable of ensuring initiation of the charge of the associated machine which is arranged so that the primary explosive cannot be initiated without going via the retardant composition, the primary pyrotechnic module being axially displaceable in the said body toward the principal charge, means for holding the primary pyrotechnic module axially separated from the principal charge and a screen interposed between the principal charge and the terminal part of the primary pyrotechnic module containing the primary explosive, characterized in that the means for holding the primary pyrotechnic module axially separated from the principal charge are exclusively mechanical means, actuated by the trigger lever and in that the screen interposed between the principal charge and the terminal part of the primary pyrotechnic module, comprises a closure cap of a cup containing the principal charge and a pellet carried by the end of the primary pyrotechnic module containing the primary explosive and engaged in the cap, the pellet and the cap being shaped in order to be made integral with each other in the case of excitation of the primary explosive in the storage position and to create a physical barrier to the shock wave or to the fragments.

In this way, in the igniter plug according to the invention, the screen effect is obtained in the storage position by axial separation between these two primary and secondary pyrotechnic modules, the axial sliding of the two modules being hindered by the holding means. In the case of an incident during storage, that is to say ignition of the primer without unlocking of the trigger lever, the initiation of the primary explosive housed at the base of the primary pyrotechnic module will cause the crimping of the pellet in the capsule with which it then forms a solid screen hindering the initiation of the pyrotechnic charge of the secondary module.

Thus, the safety of use and of storage of the invention is complete.

The invention will be better understood with the aid of the description which is to follow, given solely by way of example and made with reference to the attached drawings, in which:

DESCRIPTION OF PREFERRED EMBODIMENT

Figure 1:
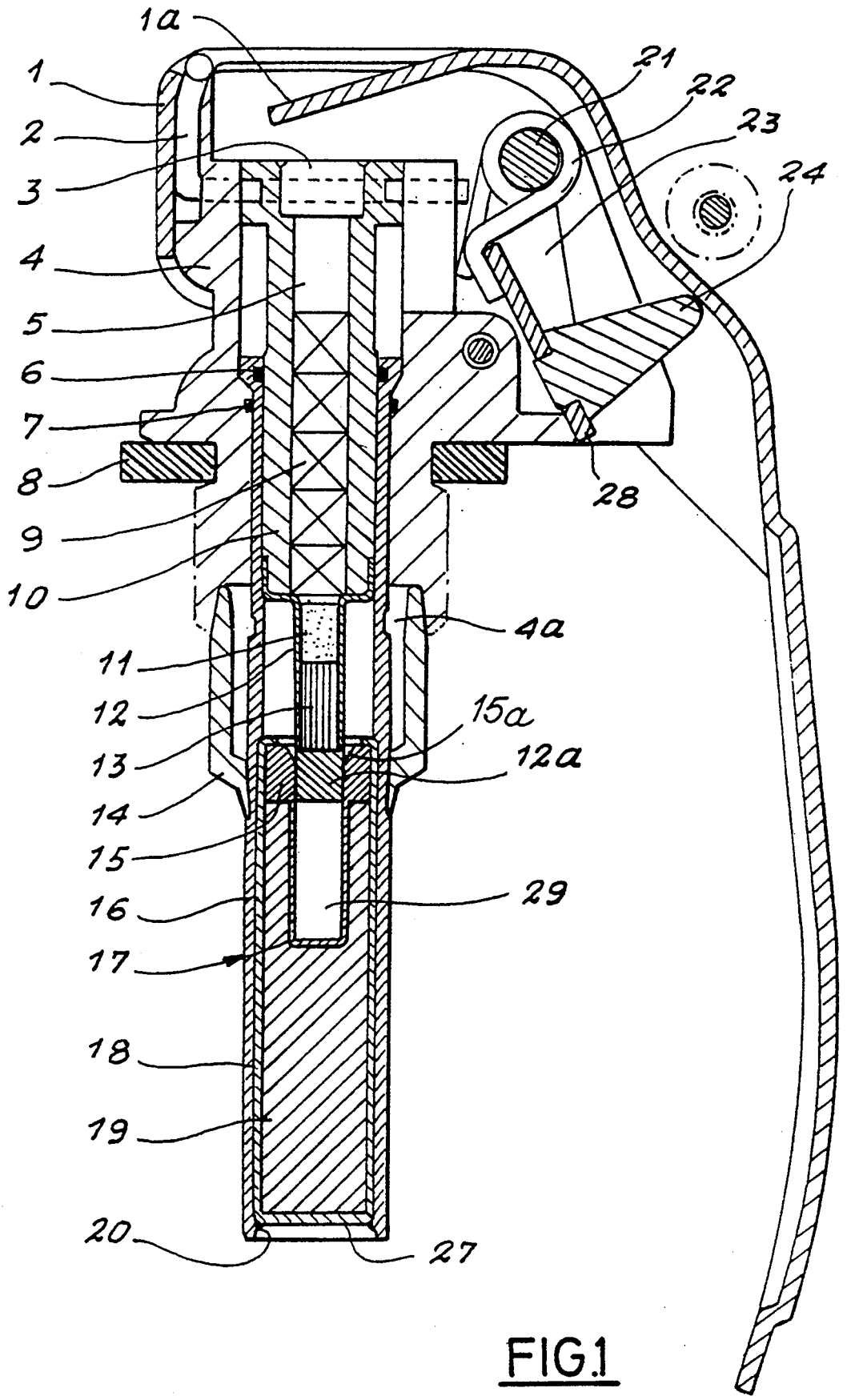
FIG. 1 is a sectional view and longitudinal elevation of an embodiment of the igniter plug according to the invention.

In the embodiment represented in FIGS. 1 to 4, the delay igniter plug for pyrotechnic machines, such as hand grenades, comprises a body 4 made of plastic reinforced with glass fiber, but which could alternatively be made of a light alloy or any other equivalent material.

Onto this body 4 are fitted a primary pyrotechnic module 5 and a secondary pyrotechnic module 17 which will be described in more detail hereinbelow.

The body 4 is fitted with a control mechanism of known type which comprises a trigger lever 1 fitted with a transverse locking pin 25 fitted with a gripping ring 26.

The control mechanism also comprises an elastic percussor device 28 consisting of a spring 22 wound around a transverse axle 21 interacting with a joining member 23 which carries the percussor 24. This percussor device can rotate around the axle 21, which is held by the lateral cheeks 1*b* of the lever 1.

The lever 1 is itself engaged by its front tip 1*c* in the front face of the body 4. The body 4 also comprises two incurvate lateral slopes 4*b* arranged in the lever 1 so as to guide the latter in rotation after unlocking the pin 25.

The primary pyrotechnic module 5 with delay consists of a metal case 10, made of light alloy for example, at the base of which there is crimped a cup 12 whose length and diameter correspond to those of an axial chamber 29 made in the secondary pyrotechnic module 17, as will be described in more detail hereinbelow.

The metal case 10 contains at its upper end a percussive primer 3, held by crimping and protected by a varnish or a resin. Beneath the primer 3, a retardant composition 9 is housed in the case 10.

The cup 12 crimped onto the case 10 contains an initiation composition 11 and a microdetonator 13 which constitutes the primary explosive of the pyrotechnic chain.

The base of the cup 12 is integral with a metal pellet 12*a* made from the same piece.

The case 10 is held in fixed position with respect to the body 4 by a rider 2 introduced with loose fit into two slots passing through the body 4 and the case 10.

Figure 2:
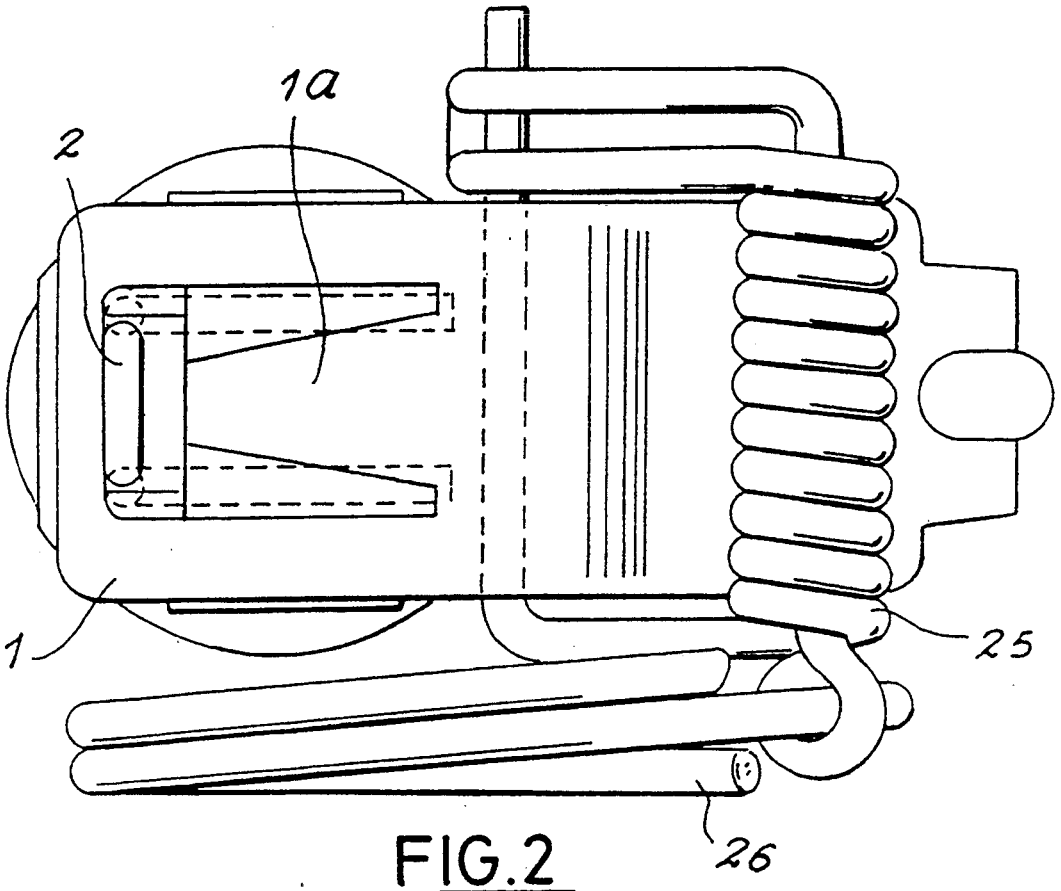
FIG. 2 is a plan top view of the igniter plug in FIG. 1, whose pin is provided with a safety ring.
Figure 3:
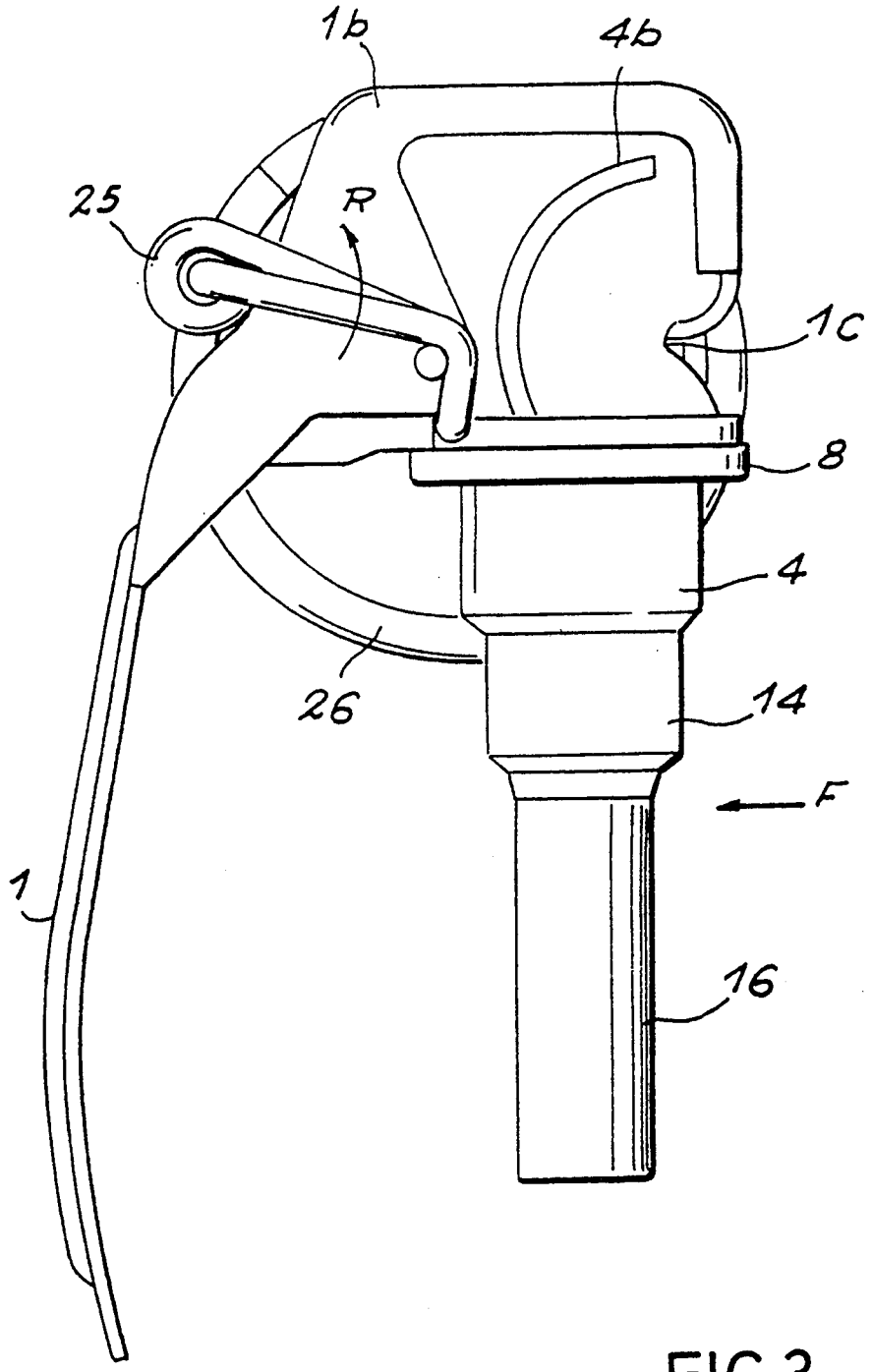
FIG. 3 is a view in elevation of the plug in FIGS. 1 and 2.
Figure 4:
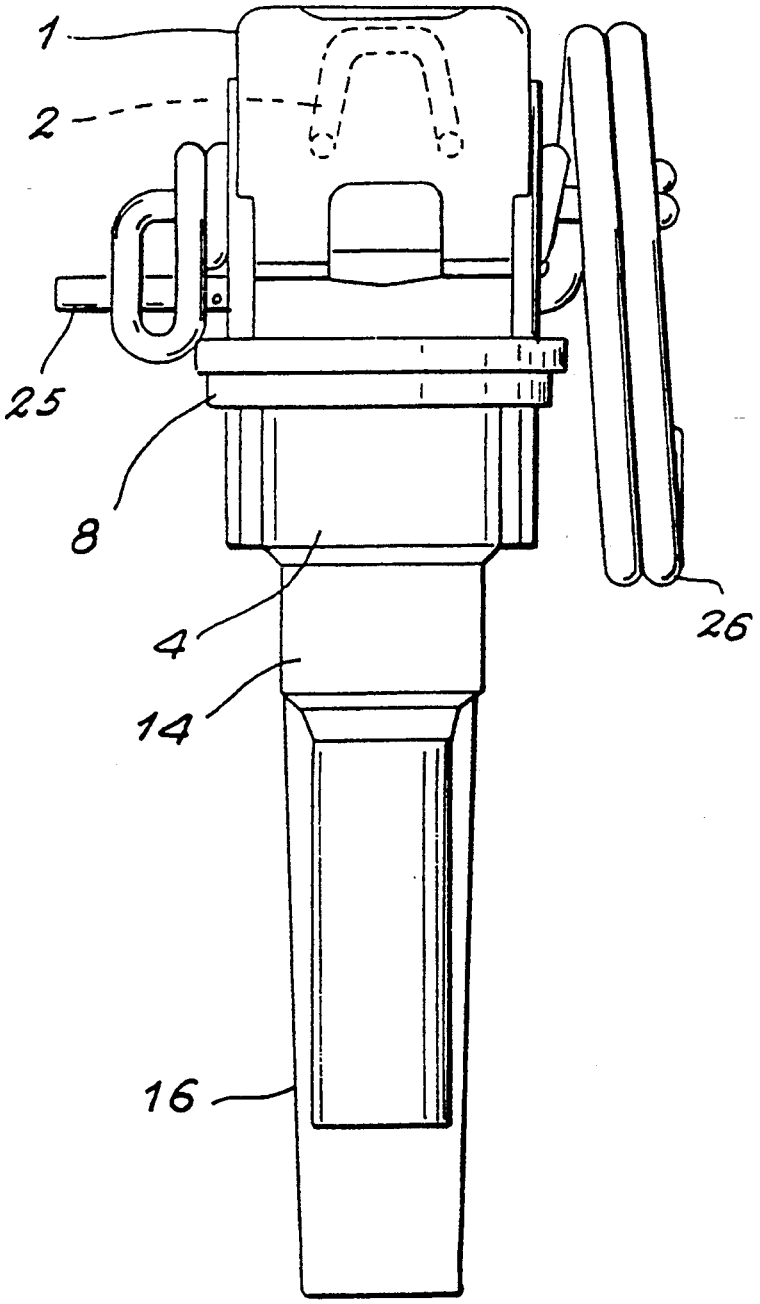
FIG. 4 is a view in elevation of the igniter plug along the direction of the arrow F in FIG. 3.

As is seen in FIGS. 1 and 2, the rider 2 comprises a vertical part forming a loop directed upward and two horizontal tabs intended to interact with the aforementioned slots. The rider is held in place by the lever 1. The said lever 1 comprises on its upper face a re-entrant finger la intended to carry away the rider 2 when the lever 1 is ejected after unlocking the pin 25.

The case 10 of the primary pyrotechnic module 5 is partially inserted into the casing 16 of the secondary pyrotechnic module 17 with however an axial spacing which allows it to slide inside the said case after the rider 2 is freed.

A seal 6 is interposed between the case 10 of the primary pyrotechnic module 5 and the case 16 of the secondary pyrotechnic module 17, while a seal 7 is interposed between the latter and the body 4.

The secondary pyrotechnic module 17 contains a detonation relay 27 consisting of an aluminum cup 18 containing a secondary explosive 19 and a closure cap 15 which, in combination with the pellet 12a disposed at the base of the cup 12 of the primary module 5, forms a screen between the microdetonator 13 and the secondary explosive 19 which constitutes the principal primer charge. The cap 15 comprises a chamfer 15*a* intended to receive portions of the wall of the cup 12 neighboring the pellet 12*a* under the effect of an accidental detonation of the primary explosive 13.

In FIG. 1, it is seen that the cup 18 comprises an axial chamber 29 whose shape matches that of the cup 12 of the primary module 5 and that the cap 15 comprises an axial opening in which, in the storage position, the pellet 12*a* of the primary module 5 comes to be housed.

Figure 1A:
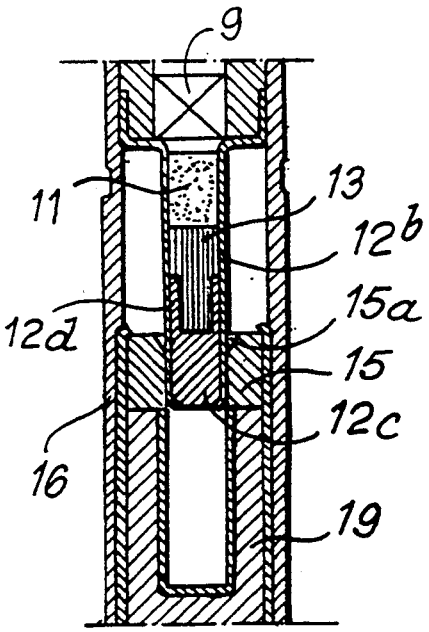
FIG. 1*a* is a partial sectional view of another embodiment of the screen for separating the primary pyrotechnic module and the principal charge of the igniter plug in the resting position.

According to the variant represented in FIG. 1*a*, the wall of the cup 12*b* is open at its end and a compound pellet 12*c* forming a safety plug is engaged and crimped at the end of the cup 12*b*. This pellet comprises a portion 12*d* with thin walls.

The end of the cup 12*b* carrying the pellet 12*c* is inserted by sliding into the collar-shaped cap 15 of the secondary module 17. The cap 15 comprises a chamfer 15*a* at its inside upper part.

The behavior of this arrangement will be described with reference to FIG. 1*b*.

The materials of the pellet 12*c* and of the cap 15 are chosen to be sufficiently strong to stop the shock wave which can be generated by the primary explosive 13, and to prevent it reaching the secondary explosive 19, and sufficiently ductile to become shaped to each other and to form a barrier when the primary module 5 is initiated in the storage position of the igniter plug.

The secondary module 17 is closed at its base by a terminating and sealing resin 20.

The case 16 of the secondary module 17 has at its upper end a collar whose lateral regions interact with the internal wall of the body 4.

The base of the body 4 connects with a box 14 whose upper lips clip into a groove made on the external wall of the case 16. This box 14 has the function of limiting the mechanical effects of the microdetonator 13 if it comes to function in the storage position.

A joint 8 placed on the body 4 coaxially with the modules 5 and 17 ensures leaktight linkage with the device on which the igniter plug is mounted.

The igniter plug according to the invention, being mounted on a machine such an explosive grenade for example, operates as follows:

The pin is removed from the grenade by extracting, by combined rotation (label R in FIG. 3) and traction, the pin 25 by means of the ring 26, then it is thrown. With the trigger lever 1 no longer held in its locking position, the elastic stress of the spring 22 makes it pivot via the precussor 24°. After a rotation of approximately 30°, the finger 1*a* of the trigger lever 1 comes to bear on the rider 2 and starts its extraction. In the following phase of the rotation of the lever, the percussor 24 escapes and comes to strike the primer 3, the rider 2 having not yet freed the primary pyrotechnic module with delay 5. By inertia, the trigger lever 1 terminates its rotation and is freed from the body 4, taking with it the rider 2, which has the effect of unlocking the primary pyrotechnic module with delay, and since the latter is still subjected to the pressure of the percussor 24 in association with the spring 22, there is a transfer of the primary pyrotechnic module with delay 5 and consequently elimination of the screen.

With the massive element or pellet 12*a* of the cup 12 coming to the bottom of the pocket 29 of the cup 18, the microdetonator 13 is then in the position of priming detonation by radial effect.

The percussion of the primer 3 has had the effect of initiating the delay composition 9. At a time determined by the delay column 9, there is an excitation of the charge 11 and by direct consequence thermal initiation of the microdetonator 13. The microdetonator 13 will by radial effect lead to the detonation of the relay 27.

If the microdetonator has for some reason come to be excited in the storage position, the element 12*a* crimps onto the crown of the cap 15 because of the rupture and of the deformation in the vicinity of the cap 12*a* of the wall of the cup 12 under the action of the detonation of the primary explosive 13, in order to form a disk. The radial effects are on the other hand blocked by the box 14.

Figure 1B:
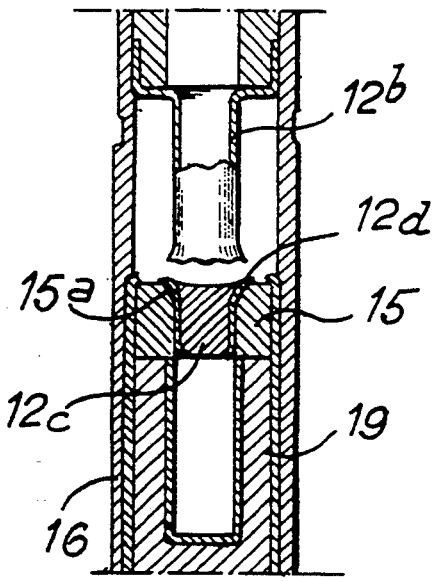
FIG. 1*b* is a view similar to that in FIG. 1*a*, showing the screen after detonation of the primary pyrotechnic module.

In the case of the embodiment represented in FIGS. 1*a* and 1*b*, the detonation of the primary explosive 13 generates a shock wave whose propagation in the safety cap 12*c* leads to the radial deformation of the portion 12*d* with thin walls due to the phenomenon called detachment of the plates.

Under the effect of the shock wave, the thin walls 12*d*, by deforming, fit onto the chamfer 15*a* of the cap 15 and make the pellet 12*c* integral with the cap 15, thus producing a physical break in the pyrotechnic chain of the igniter plug in the case of abnormal functioning of the primary module 5.

Such an operation implies:

that the allowable scatters on the internal diameter of the cap or collar 15 and external diameter of the pellet or safety plug or 12*a* or 12*c* are sufficient, that the dimensioning of the chamfer 15*a* of the cap is compatible with the height of the deformable lips or thin walls 12*d* of the pellet 12*c* in the case of the embodiment in FIGS. 1*a*, 1*b* or with the height of the portions of the wall of the cup 12 resulting from the rupture of the latter in the case of the embodiment in FIG. 1.

Figure 5:
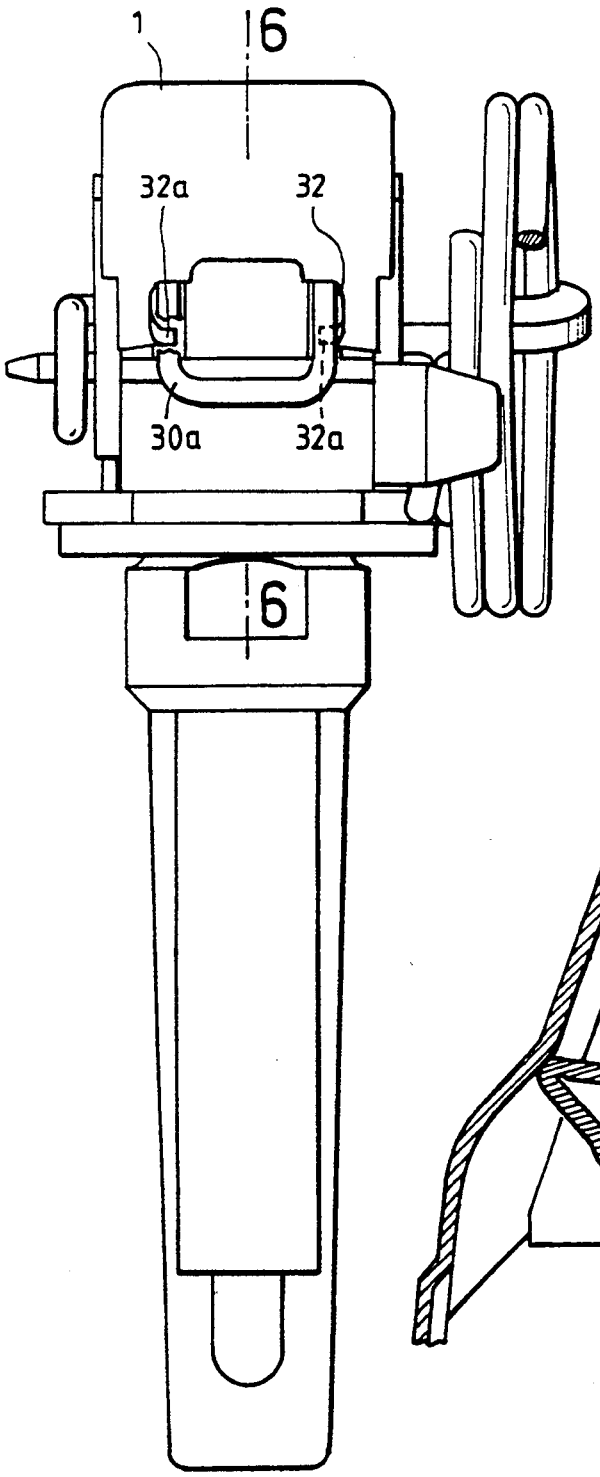
FIG. 5 is a partial external view of another embodiment of the igniter plug according to the invention.
Figure 6:
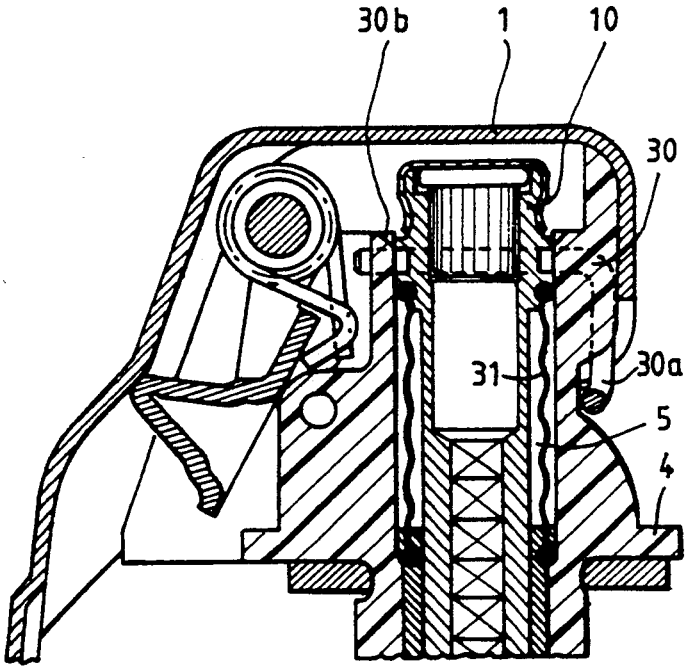
FIG. 6 is a partial sectional view along the line 6—6 in FIG. 5.

In FIGS. 5 and 6, another embodiment of the igniter plug according to the invention has been represented.

This igniter plug differs from the igniter plug described with reference to FIG. 1 essentially on two points.

It comprises a rider 30 for holding the primary pyrotechnic module 5 axially separated from the principal charge, this rider comprising a vertical part 30*a* in the shape of a loop directed downward and horizontal tabs 30*b* similar to those of the rider 2 of the embodiment in FIG. 1 engaged in the body 4 of the plug and in the case 10 of the primary pyrotechnic module 5.

In this embodiment, the case 10 of the primary module 5 is mounted so as to slide in the case 16 of the secondary module 17 with interposition of a bellows seal 31.

The actuation lever 1 whose construction is similar to that of the lever 1 of the embodiment in FIG. 1 differs from the latter in that instead of a finger for extracting the rider, it comprises an extraction member formed by a notch 32 made in the part of the lever 1 neighboring the loop, the said notch comprising folded-down tabs 32*a* engaged behind the loop 30*a* of the rider 30 in the resting position and ensuring the extraction of the rider 30 when the trigger lever 1 is freed from the body 4.

The remainder of the construction and operation of this embodiment of the igniter plug is the same as for the plug in FIG. 1.

Thus, the improvements provided by the present invention considerably improve the safety of storage and of use of the igniter plug and of the machine on which it is mounted.

The invention is not limited to the embodiments described and may comprise other variations thereof as defined by the appended claims.

What is claimed is:

1. Delay igniter plug for a manual or mechanical launch pyrotechnic machine, comprising a body (4) fitted with a control mechanism comprising a trigger lever (1) and a percussion mechanism (28) interacting with a primary pyrotechnic module provided with a primer (3), a retardant composition (9), a primary explosive (13) for ensuring initiation of a charge of an associated machine, said primary pyrotechnic module being arranged so that the primary explosive (13) cannot be initiated without going via the retardant composition, the primary pyrotechnic module (5) being axially displaceable in said body toward a principal charge, means (2) for holding the primary pyrotechnic module (5) axially separated from the principal charge (19) and a screen (12*a*, 15; 12*c*, 15) interposed between the principal charge and a terminal part of the primary pyrotechnic module containing the primary explosive (13), characterized in that the means (2) for holding the primary pyrotechnic module (5) axially separated from the principal charge (19) are exclusively mechanical means, actuated by the trigger lever (1) and in that the screen interposed between the principal charge and the terminal part of the primary pyrotechnic module (5), comprises a closure cap (15) of a cup (18) containing the principal charge (19) and a pellet (12*a*; 12*c*) carried by an end of the primary pyrotechnic module (5) containing the primary explosive (13) and engaged in the cap (15), the pellet (12*a*; 12*c*) and the cap (15) being rendered integral with each other in the case of excitation of the primary explosive (13) in the storage position and creating a physical barrier to the shock wave or to the fragments.

2. Igniter plug according to claim 1, characterized in that the pellet (12*a*) is formed in a single piece with a cup (12) containing the primary explosive (13) and the pellet (12*a*) is made integral with the cap (15) by crimping due to the rupture and to the deformation in the vicinity of the cap (12*a*) of a wall (12) of the primary pyrotechnic module under the action of the detonation of the primary explosive (13) which it contains, and fitting of the wall onto a chamfer (15*a*) of the cap (15).

3. Igniter plug according to claim 1, characterized in that the pellet (12*c*) is a compound article provided with a portion (12*d*) with thin walls, engaged in an end of a cup (12*b*) containing the primary explosive (13) and in that the pellet (12*c*) is made integral with the cap (15) by crimping by radial deformation of the portion (12*b*) with thin walls under effect of the shock wave generated by the deformation of the primary explosive (13) and fitting of the thin walls onto a chamfer (15*a*) of the cap (15).

4. Igniter plug according to any one of claims 1 to 3, characterized in that the means for holding the primary pyrotechnic module (5) axially separated from the principal charge (19), comprise a rider (2;30) housed in body (4) of the plug and engaging with the primary pyrotechnic module (5), said trigger lever (1) comprising a member (1*a*;32*a*) for extracting the rider, when the trigger lever (1) is freed from the body of the said plug.

5. Igniter plug according to claim 4, characterized in that the rider (2) comprises a vertical part forming a loop and two horizontal tabs interact with transverse slots made at the upper part of the body (4) and of the primary module (5).

6. Igniter plug according to claim 5, characterized in that the rider (2) comprises a vertical part forming a loop directed upward and the member for removing the rider (2) is a finger (1*a*) carried by the lever and interacting with the vertical part (2*a*) in order to extract the rider from the body when the trigger lever (1) is freed.

7. Igniter plug according to claim 5, characterized in that the rider (30) comprises a vertical part (30*a*) forming a loop directed downward and the member for removing the rider (30) is formed by folded-down tabs (32*a*) of a notch (32) made in a part of the trigger lever (1) neighboring the loop (30*a*), the tabs (32*a*) being engaged behind the loop (30*a*) and interacting with the latter by traction in order to extract the rider from the body when the trigger lever (1) is freed from the body (4).

8. Igniter plug according to one of claim 1, characterized in that the principal charge (19) is contained in a secondary pyrotechnic module (17) comprising a case (16), inside which the primary pyrotechnic module (5) is partially inserted by sliding.

9. Igniter plug according to claim 1, characterized in that the igniter plug comprises at the base of its body (4) an attached box (14) surrounding the primary explosive (13) in a locked position of the plug.

10. Igniter plug according to claim 6, characterized in that the percussion mechanism (28) constitutes a means of displacing the primary pyrotechnic module (5) in translation in the body (4).

* * * * *